US006581031B1

(12) United States Patent
Ito et al.

(10) Patent No.: US 6,581,031 B1
(45) Date of Patent: Jun. 17, 2003

(54) SPEECH ENCODING METHOD AND SPEECH ENCODING SYSTEM

(75) Inventors: Hironori Ito, Tokyo (JP); Kazunori Ozawa, Tokyo (JP); Masahiro Serizawa, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/450,305

(22) Filed: Nov. 29, 1999

(30) Foreign Application Priority Data

Nov. 27, 1998 (JP) ..... 10-337805

(51) Int. Cl.[7] ..... G10L 19/12
(52) U.S. Cl. ..... 704/222; 704/501; 704/207
(58) Field of Search ..... 704/207, 208, 704/209, 217, 219, 220, 222, 223, 262, 265, 501

(56) References Cited

U.S. PATENT DOCUMENTS

| | | | | | |
|---|---|---|---|---|---|
| 5,426,718 | A | * | 6/1995 | Funaki et al. | 704/223 |
| 5,596,676 | A | * | 1/1997 | Swaminathan et al. | 704/208 |
| 5,737,484 | A | | 4/1998 | Ozawa | |
| 5,819,213 | A | * | 10/1998 | Oshikiri et al. | 704/222 |
| 6,073,092 | A | * | 6/2000 | Kwon | 704/219 |
| 6,226,604 | B1 | * | 5/2001 | Ehara et al. | 704/207 |

FOREIGN PATENT DOCUMENTS

| | | | |
|---|---|---|---|
| EP | 0749110 | 12/1996 | |
| EP | 0628947 | * 2/1998 | G10L/11/04 |
| EP | 0877355 | 11/1998 | |
| JP | 4-171500 | 6/1992 | |
| JP | 4-363000 | 12/1992 | |
| JP | 5-6199 | 1/1993 | |
| JP | 6-222797 | 8/1994 | |
| JP | 8-320700 | 12/1996 | |

OTHER PUBLICATIONS

Schroeder et al., "Code–Excited Linear Prediction: high Quality Speech at Very Low Bit Rates," Proc. ICASSP, pp. 937–940, 1985.

"Improved Speech Quality and Efficient Vector Quantization in SELP," Proc. ICASSP, pp. 155–158, 1988.

Nakamizo, "Signal Analysis and System Identification," CORONA Corp., pp. 82–87, 1988.

(List continued on next page.)

*Primary Examiner*—Daniel Abebe
(74) *Attorney, Agent, or Firm*—Dickstein, Shapiro, Morin & Oshinsky LLP

(57) ABSTRACT

In this speech encoding system, the limiter circuit is input with the delay of adaptive codebook obtained for the previous subframe, and the pitch cycle search range is limited so that the delay of adaptive codebook obtained for the previous subframe is not discontinuous to the delay of adaptive codebook to be obtained for the current subframe, and the pitch cycle search range limited is output to the pitch calculation circuit. The pitch calculation circuit is input with output signal $X_w(n)$ of the perceptual weighting circuit and the pitch cycle search range output from the limiter, calculating the pitch cycle $T_{op}$, then outputting at least one pitch cycle $T_{op}$ to the adaptive codebook circuit. The adaptive codebook circuit is input with the perceptual weighting signal $x'_w(n)$, the past excitation signal v(n) output from the gain quantization circuit, the perceptual weighting impulse response $h_w(n)$ output from the impulse response calculation circuit, and the pitch cycle $T_{op}$ from the pitch calculation circuit, searching near the pitch cycle, calculating the delay of adaptive codebook. With the above composition, the delay of adaptive codebook obtained for each subframe can be prevented from being discontinuous in the process of time.

6 Claims, 4 Drawing Sheets

OTHER PUBLICATIONS

Sugamura et al., "Speech Information Compression by Line Spectrum Pair (LSP) Speech Analysis and Synthesis," J. of IECEJ, J64–A, pp. 599–606, 1981.

T. Nomura et al., "LSP Coding Using VQ–SVQ With Interpolation in 4.075 kbps M–LCELP Speech Coder," Proc. Mobile Multimedia Communications, pp. B.2.5, 1993.

P. Kroon et al., "Pitch Predictors With High Temporal Resolution," Proc. ICASSP, pp. 661–664, 1990.

Linde et al., "An Algorithm for Vector Quantization Design," IEEE Trans. Commun., pp. 84–95, Jan., 1980.

O'Neill C. et al: "An Efficient Algorithm for Pitch Prediction Using Fractional Delays," Proceedings of the European Signal Processing Conference (EUSIPCO), NL, Amsterdam, Elsevier, vol. Conf. 6, 1992, pp. 319–322, XP000348668 ISBN: 0–444–89587–6 *abstract*, *p. 321, left–hand col., lines 26–33*.

Ozawa K: "4 kb/s Multi–pulse Based CELP Speech Coding Using Excitation Switchign," 1999 IEEE International Conference on Acoustics, Speech, and Signal Processing. Proceedings. ICASSP99 (CAP. No. 99CH36258), 1999 IEEE International Conference on Acoustics, Speech, and Signal Processing. Proceedings. ICASSP99, Phoenix, AZ, USA, Mar. 15–19, 1999, pp. 189–192, vol. 1, XP002131315, 1999, Piscataway, NJ, USA, IEEE, USA, ISBN: 0–7803–5041–3 *abstract*, *p. 189; figure 1*, and *p. 190; Figure 3*.

* cited by examiner

SPEECH ENCODING METHOD AND SPEECH ENCODING SYSTEM

FIELD OF THE INVENTION

This invention relates to a speech encoding method and a speech encoding system used to encode voice signal in high quality at a low bit rate.

BACKGROUND OF THE INVENTION

Known as a method of encoding voice signal in high efficiency is CELP (code excited linear predictive coding) described in, for example, M. Schroeder and B. Atal, "Code-Excited Linear Prediction: High Quality Speech at Very Low Bit Rates", Proc. ICASSP, pp.937–940, 1985 (prior art 1), and Kleij et al., "Improved Speech Quality and Efficient Vector Quantization in SELP", Proc. ICASSP, pp.155–158, 1988 (prior art 2).

In CELP, on the transmission side, for each frame, e.g. 20 ms, spectral parameter to spectral characteristic is extracted from speech signal by using LPC (linear predictive coding) analysis. A frame is further divided into subframes, e.g. 5 ms, and for each subframe, based on past excitation signal, parameters (delay. parameter and gain parameter corresponding to pitch cycle) at adaptive codebook are extracted, and speech signal of the subframe is pitch-predicted by the adaptive codebook. For excitation signal obtained by the pitch-predicting, an optimum sound-source code vector is selected from a sound-source codebook (vector quantization codebook) composed of a predetermined kind of noise signals, and the excitation signal is quantized by calculating optimum gain. The selection of sound-source code vector is conducted so that the error electric power between signal synthesized by the selected noise signal and residual signal can be minimized. Then, the index and gain to indicate the kind of code vector selected, the spectral parameter and the adaptive codebook parameter are combined by a multiplexer and transmitted.

However, in CELP described above, there is a problem that when the delay of adaptive codebook extracted for current subframe is more than an integer times or less than the inverse number of an integer times, where the integer is two or more, the delay of adaptive codebook calculated for the previous subframe, between the previous codebook and current codebook, the delay of adaptive codebook becomes discontinuous and therefore the tone quality deteriorates. The reason is as follows: although the delay of adaptive codebook extracted for current subframe is searched near a pitch cycle calculated from speech signal by a pitch calculator, when the pitch cycle becomes more than an integer times or less than the inverse number of an integer times the delay of adaptive codebook calculated for the previous subframe, the search range of adaptive codebook for the current subframe does not include near the delay of adaptive codebook for the previous subframe. Therefore, between the previous codebook and current codebook, the delay of adaptive codebook becomes discontinuous in the process of time.

SUMMARY OF THE INVENTION

Accordingly, it is an object of the invention to provide a speech encoding method and a speech encoding system that the delay of adaptive codebook calculated for each subframe can be prevented from being discontinuous in the process of time.

According to the invention, a speech encoding method, comprises the steps of:

calculating a spectral parameter from speech signal to be input and quantizing the spectral parameter;

calculating delay and gain from excitation signal quantized in the past according to an adaptive codebook and calculating the residual by predicting speech signal, based on a pitch cycle;

quantizing the excitation signal of the speech signal by using the spectral parameter;

quantizing the gain of the excitation signal; and limiting the search range in searching the pitch cycle based on the delay of adaptive codebook calculated in the past and searching the pitch cycle from the speech signal.

According to another aspect of the invention, a speech encoding method, comprises the steps of:

calculating a spectral parameter from speech signal to be input and quantizing the spectral parameter;

calculating delay and gain from excitation signal quantized in the past according to an adaptive codebook and calculating the residual by predicting speech signal, based on a pitch cycle;

quantizing the excitation signal of the speech signal by using the spectral parameter;

quantizing the gain of the excitation signal;

determining a mode by extracting a characteristic quantity from the speech signal; and limiting the search range in searching the pitch cycle based on the delay of adaptive codebook calculated in the past and searching the pitch cycle from the speech signal, when the determined mode corresponds to a predetermined mode.

According to another aspect of the invention, a speech encoding system, comprises:

a spectral parameter calculation unit that calculates a spectral parameter from speech signal to be input and quantizes the spectral parameter;

a pitch calculation unit that outputs calculating a pitch cycle from the speech signal;

an adaptive codebook unit that calculates delay and gain from excitation signal quantized in the past according to an adaptive codebook and calculates the residual by predicting speech signal, based on the output of the pitch calculation unit, and that outputs the calculated delay and gain;

a excitation quantization unit that outputs quantizing the excitation signal of the speech signal by using the spectral parameter;

a gain quantization unit that outputs quantizing the gain of the excitation signal; and a limiter unit that limits the search range in searching the pitch cycle based on the delay of adaptive codebook calculated in the past;

wherein the pitch calculation unit outputs searching the pitch cycle based on the output of the limiter unit.

According to another aspect of the invention, a speech encoding system, comprises:

a spectral parameter calculation unit that calculates a spectral parameter from speech signal to be input and quantizes the spectral parameter;

a pitch calculation unit that outputs calculating a pitch cycle from the speech signal;

an adaptive codebook unit that calculates multiple delays and gain from excitation signal quantized in the past according to an adaptive codebook and calculates the residual by predicting speech signal, based on the output of the pitch calculation unit, and that outputs the calculated delays and gain;

a excitation quantization unit that quantizes the excitation signal of the speech signal for each of the multiple delays by using the spectral parameter and then outputs selecting one with smaller signal distortion;

a gain quantization unit that outputs quantizing the gain of the excitation signal; and a limiter unit that limits the search range in searching the pitch cycle based on the delay of adaptive codebook calculated in the past;

wherein the pitch calculation unit outputs searching the pitch cycle based on the output of the limiter unit.

According to another aspect of the invention, a speech encoding system, comprises:

a spectral parameter calculation unit that calculates a spectral parameter from speech signal to be input and quantizes the spectral parameter;

a pitch calculation unit that outputs calculating a pitch cycle from the speech signal;

an adaptive codebook unit that calculates delay and gain from excitation signal quantized in the past according to an adaptive codebook and calculates the residual by predicting speech signal, based on the output of the pitch calculation unit, and that outputs the calculated delay and gain;

a excitation quantization unit that outputs quantizing the excitation signal of the speech signal by using the spectral parameter;

a mode determination unit that determines a mode by extracting a characteristic quantity from the speech signal;

a gain quantization unit that outputs quantizing the gain of the excitation signal; and a limiter unit that limits the search range in searching the pitch cycle based on the delay of adaptive codebook calculated in the past, when the output of the mode determination unit corresponds to a predetermined mode;

wherein the pitch calculation unit outputs searching the pitch cycle based on the output of the limiter unit, when the output of the mode determination unit corresponds to the predetermined mode.

According to another aspect of the invention, a speech encoding system, comprises:

a spectral parameter calculation unit that calculates a spectral parameter from speech signal to be input and quantizes the spectral parameter;

a pitch calculation unit that outputs calculating a pitch cycle from the speech signal;

an adaptive codebook unit that calculates multiple delays and gain from excitation signal quantized in the past according to an adaptive codebook and calculates the residual by predicting speech signal, based on the output of the pitch calculation unit, and that outputs the calculated delays and gain;

a excitation quantization unit that quantizes the excitation signal of the speech signal by using the spectral parameter and then outputs selecting one with smaller signal distortion;

a mode determination unit that determines a mode by extracting a characteristic quantity from the speech signal;

a gain quantization unit that outputs quantizing the gain of the excitation signal; and a limiter unit that limits the search range in searching the pitch cycle based on the delay of adaptive codebook calculated in the past, when the output of the mode determination unit corresponds to a predetermined mode;

wherein the pitch calculation unit outputs searching the pitch cycle based on the output of the limiter unit, when the output of the mode determination unit corresponds to the predetermined mode.

Functions of the Invention

In this invention, the limiter unit is input with the delay of adaptive codebook obtained for the previous subframe, and the search range of pitch cycle is limited so that the delay of adaptive codebook obtained for the previous subframe is not discontinuous to the delay of adaptive codebook to be obtained for the current subframe, and the search range of pitch cycle limited is output to the pitch calculation unit.

The pitch calculation unit is input with perceptual weighting output signal and the search range of pitch cycle output from the limiter unit, calculating the pitch cycle, then outputting at least one pitch cycle to the adaptive codebook unit. The adaptive codebook unit is input with the perceptual weighting signal, the past excitation signal output from the gain quantization unit, the perceptual weighting impulse response output from the impulse response calculation circuit, and the pitch cycle from the pitch calculation unit, searching near the pitch cycle, calculating the delay of adaptive codebook. By using the above composition, the delay of adaptive codebook obtained for each subframe can be prevented from being discontinuous in the process of time.

BRIEF DESCRIPTION OF THE DRAWINGS

The invention will be explained in more detail in conjunction with the appended drawings, wherein.

DESCRIPTION OF THE PREFERRED EMBODIMENTS

Figure 1:
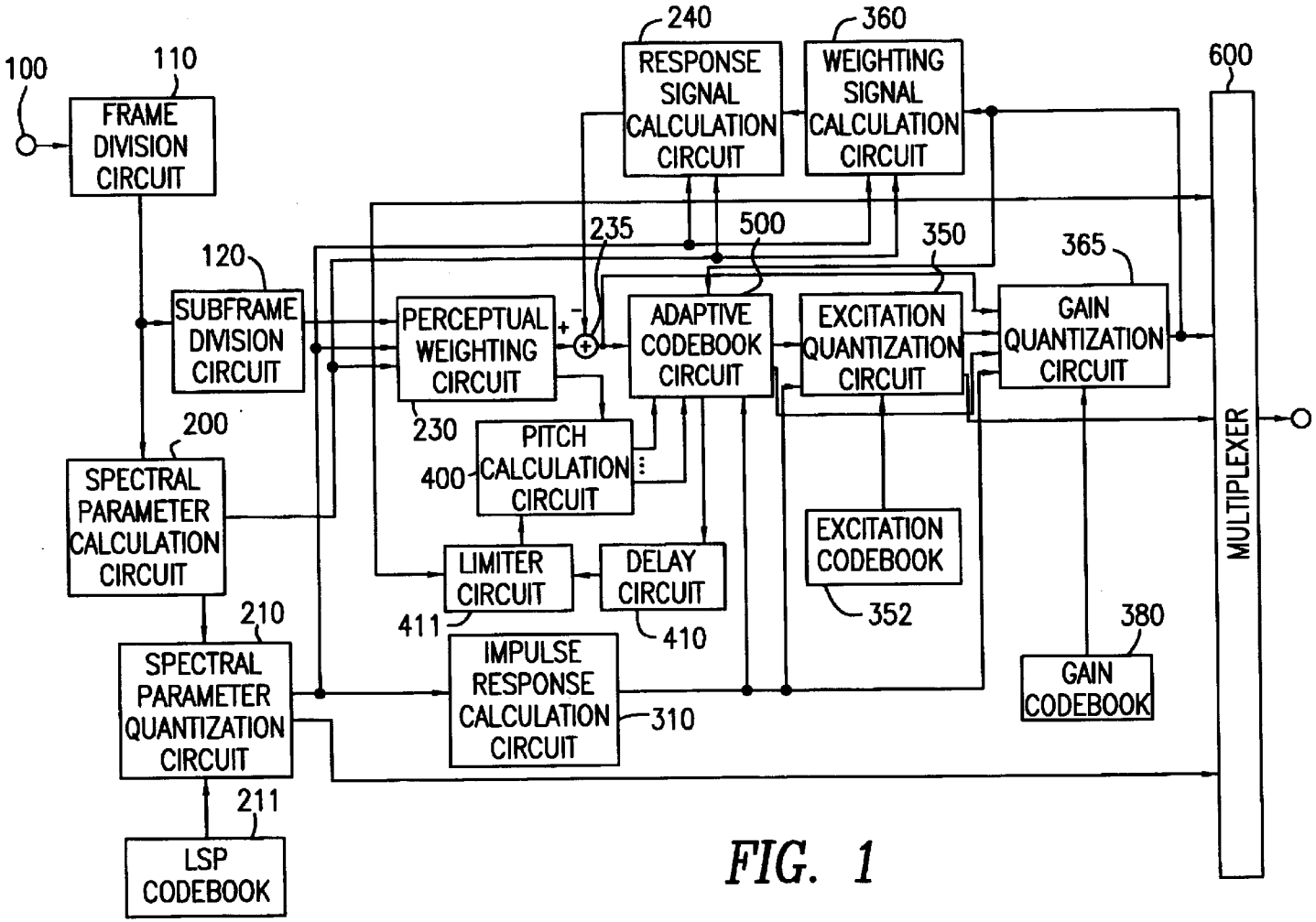
FIG. 1 is a block diagram showing the composition of a speech encoding system in a first preferred embodiment according to the invention.

The preferred embodiments according to the invention will be explained referring to the drawings.

First Embodiment

FIG. 1 is a block diagram showing the composition of a speech encoding system in the first preferred embodiment according to the invention. This speech encoding system is configured adding a pitch calculation circuit 400, a delay circuit 410 and a limiter circuit 411 to a speech encoding system that is similar to a speech encoding system disclosed in Japanese patent application laid-open No. 08-320700 (1996) (prior art 3) which is filed by the inventor of the present application. Meanwhile, although two sets of gain codebooks are provided for the system in prior art 3, one gain codebook is provided herein.

The speech encoding system is provided with a frame division circuit 110 that divides speech signal to be input from an input terminal 100 into frames of, e.g. 20 ms. The frames are output to a subframe division circuit 120 and a spectral parameter calculation circuit 200. The subframe division circuit 120 divides frame speech signal into subframes of, e.g. 5 ms, shorter than the frame.

The spectral parameter calculation circuit 200 applies a window (e.g. 24 ms) longer than the length of subframe to at least one subframe speech signal to take out voice, calculating the spectral parameter at a predetermined number of order, e.g. P=10. Here, the calculation of spectral parameter can be performed by using well-known LPC analysis, Burg analysis etc. Herein, the Burg analysis is used. The details of the Burg analysis are, for example, described in Nakamizo, "Signal Analysis and System Identification", CORONA Corp., pp.82–87, 1988 (prior art 4). Therefore the explanation is omitted herein. Further, in the spectral parameter calculation circuit 200, linear predictive coefficient $\alpha_i$ (i=1, . . . ,10) calculated by the Burg method is converted into LSP (line spectrum pair) parameter that is suitable for quantization or interpolation. Here, the conversion from the linear predictive coefficient to the LSP is described in Sugamura et al., "Speech Information Compression by Line Spectrum Pair (LSP) Speech Analysis and Synthesis", J. of IECEJ, J64-A, pp.599–606, 1981 (prior art 5). For example, a linear predictive coefficient calculated for second and fourth subframes by the Burg method is converted into LSP parameter, thereby LSP for first and third subframes is calculated by linear interpolation, the LSP calculated by the interpolation is inverse-transformed to a linear predictive coefficient, and linear predictive coefficients $\alpha_{il}$ (i=1, . . . , 10, l=1, . . . , 5) of the first to fourth subframes are output to an perceptual weighting circuit 230. Also, LSP for the fourth subframe is output to a spectral parameter quantization circuit 210.

The spectral parameter quantization circuit 210 refers to a LSP codebook 211, quantizing efficiently the LSP parameter of a predetermined subframe, outputting a quantization value to minimize distortion $D_j$ given by:

$$D_j = \sum_{i=1}^{10} W(i)[LSP(i) - QLSP(i)_j]^2 \tag{1}$$

where LSP(i), QLSP(i)j and W(i) are the $i_{th}$-order LSP before the quantization, the $j_{th}$ result after the quantization and weight coefficient, respectively.

In the examples below, vector quantization is used as the quantization method and the LSP parameter for the fourth subframe is quantized. The vector quantization of LSP parameter can be performed by using well-known methods. For example, the methods are described in Japanese patent application laid-open No.04-171500 (1992) (prior art 6), Japanese patent application laid-open No.04-363000 (1992) (prior art 7), Japanese patent application laid-open No.05-6199 (1993) (prior art 8), T. Nomura et al., "LSP Coding Using VQ-SVQ with Interpolation in 4.075 kbps M-LCELP Speech Coder", Proc. Mobile Multimedia Communications, pp.B.2.5, 1993 (prior art 9). Therefore, the explanation is omitted herein.

Also, the spectral parameter quantization circuit 210 restores the LSP parameters for the first to fourth subframes, based on the LSP parameter to be quantized for the fourth subframe. Hereupon, by conducting the linear interpolation using quantized LSP parameter for the fourth subframe of the current frame and quantized LSP parameter for the fourth subframe of the previous frame, LSPs for the first to third subframes of the current frame are restored. Here, after selecting such one kind of code vector that can minimize the error electric power between LSP before quantization and LSP after quantization, LSPs for the first to fourth subframes can be restored by linear interpolation. In order to further enhance the performance, after selecting multiple prospective code vectors to minimize the error electric power, for each prospective code vector, the accumulated distortion accumulated is evaluated. Then, the combination of a prospective code vector to minimize the accumulated distortion and an interpolation LSP can be selected. The detailed method is, for example, is described in Japanese patent application laid-open No.06-222797 (1994) (prior art 10).

The spectral parameter quantization circuit 210 converts the LSPs for the first to third subframes, restored as described above, and the quantized LSP for the fourth subframe into linear predictive coefficient $\alpha'_{il}$ (i=1, . . . , 10, l=1, . . . , 5) for each subframe, outputting them to an impulse response calculation circuit 310. Also, it outputs an index to indicate the code vector of the quantized LSP for the fourth subframe to a multiplexer 600.

The spectral parameter calculation circuit 200, the spectral parameter quantization circuit 210 and the LSP codebook 211 compose a spectral parameter calculation unit for calculating the spectral parameter of input speech signal, quantizing it, then outputting it.

Also, the speech encoding system is provided with the perceptual weighting circuit 230 to conduct the perceptual weighting. The perceptual weighting circuit 230 is input with linear predictive coefficient $\alpha'_{il}$ (i=1, . . . , 10, l=1, . . . , 5) before the quantization for each subframe from the spectral parameter calculation circuit 200, and according to prior art 1, it conducts the perceptual weighting to the subframe speech signal, then outputting perceptual weighting signal $X_w(n)$.

The pitch calculation circuit 400 is input with the perceptual weighting signal X,(n) of the perceptual weighting circuit 230 and a pitch cycle search range to be output from the limiter circuit 411, calculating a pitch cycle $T_{op}$ within this pitch cycle search range, outputting at least one pitch cycle to an adaptive codebook circuit 500. Selected as the pitch cycle $T_{op}$ is such a value that, within this pitch cycle search range, maximizes the equation below.

$$g_{op} = \sum_{n=1}^{l} X_W(n) \times X_W(n + T_{op}) \Big/ \sum_{n=1}^{l} \sqrt{X_W^2(n + T_{op})} \tag{2}$$

where L is a pitch analysis length. Here, the pitch calculation circuit 400 is a pitch calculator that outputs calculating the pitch cycle from speech signal, and the limiter circuit 411 is a limiter that when searching the pitch cycle, limits the search range based on the delay of adaptive codebook calculated previously.

The delay circuit 410 is disposed between the adaptive codebook circuit 500 and the limiter circuit 411. The delay circuit 410 is input with the delay of adaptive codebook of the current subframe from the adaptive codebook circuit 500, storing the value until processing the next subframe, outputting the delay of adaptive codebook of the previous subframe to the limiter circuit 411.

The limiter circuit 411 is input with the delay of adaptive codebook calculated for the previous subframe to be output from the delay circuit 410, then outputs the pitch cycle search range. The limiting is, for example, performed as below.

At first, prepared is a table that the range of pitch cycle to be searched is divided into three sections as shown in Table 1.

TABLE 1

| | |
|---|---|
| section 1 | 17, 18, 19, 20, . . . , 31, 32, 33, 35 |
| section 2 | 36, 37, 38, 39, . . . , 68, 69, 70, 71 |
| section 3 | 72, 73, 74, 75, . . . , 141, 142, 143, 144 |

For example, if the delay of adaptive codebook calculated for the previous subframe belongs to section 1, then the search range is limited to section 1 and section 2. Here, as the division table for the pitch cycle search range, another table other than Table 1 may be used. Alternatively, the table may be changed in the process of time.

A response signal calculation circuit 240 to calculate response signal is input with linear predictive coefficient $\alpha_{il}$ for each subframe from the spectral parameter calculation circuit 200, input with linear predictive coefficient $\alpha'_{il}$, which is quantized, interpolated and restored, for each subframe from the spectral parameter quantization circuit 210, then calculating response signal that input signal is made zero [d(n)=0] for one subframe by using a stored value of filter memory, outputting it to a subtracter 235. Here, response signal $x_z(n)$ is given by:

$$x_z(n) = d(n) - \sum_{i=1}^{10} \alpha_i d(n-i) + \sum_{i=1}^{10} \alpha_i \gamma^i y(n-i) + \sum_{i=1}^{10} \alpha'_i \gamma^i x_z(n-i) \tag{3}$$

in case of $$(n-i) \leqq 0,\ y(n-i) = p(N+(n-i)) \tag{4}$$

$$\text{and } x_z(n-i) = s_w(N+(n-i)) \tag{5}$$

where N is a subframe length, γ is a weighting coefficient to control the amount of perceptual weighting and is the same value as that in equation 8 described later, $s_w(n)$ and p(n) are output signal of a weighting signal calculation circuit 360 and output signal represented as a denominator of the first section (filter) at the right side of equation 7, described later, respectively. The weighting signal calculation circuit 360 is explained later.

The subtracter 235, according to the equation below, subtracts response signal $x_z(n)$ to one subframe from perceptual weighting signal $X_w(n)$ to be output from the perceptual weighting circuit 230, then outputting $x'_w(n)$ to the adaptive codebook circuit 500.

$$D_T = \sum_{n=0}^{N-1} x'^2_w(n) - \left[\sum_{n=0}^{N-1} x_w(n) y_w(n-T)\right]^2 \Big/ \left[\sum_{n=0}^{N-1} y^2_w(n-T)\right] \tag{6}$$

Further, provided is the impulse response calculation circuit 310 that calculates impulse response from quantized spectral parameter. The impulse response calculation circuit 310 calculates a predetermined number L of the impulse response $h_w(n)$ of perceptual weighting filter that the z-transform is represented by the equation below, then outputting it the adaptive codebook circuit 500 and a excitation quantization circuit 350.

$$H_w(z) = \frac{1 - \sum_{i=1}^{10} \alpha_i z^{-i}}{1 - \sum_{i=1}^{10} \alpha_i \gamma^i z^{-i}} \frac{1}{1 - \sum_{i=1}^{10} \alpha'_i \gamma^i z^{-i}} \tag{7}$$

The adaptive codebook circuit 500 calculates delay T and gain β by the adaptive codebook from excitation signal quantized in the past based on the output of the pitch calculation circuit 400, calculating the residue (predictive residual signal $e_w(n)$ ) by predicting the speech signal, outputting the delay T, gain β and predictive residual signal $e_w(n)$. The adaptive codebook circuit 500 is input with past excitation signal v(n) from a gain quantization circuit 365, described later, output signal $x'_w(n)$ from the subtracter 235, perceptual weighting impulse response $h_w(n)$ from the impulse response calculation circuit 310, and pitch cycle $T_{op}$ from the pitch calculation circuit 400. The adaptive codebook circuit 500 searches near the pitch cycle $T_{op}$, calculating delay T of adaptive codebook so as to minimize the distortion in the equation below, then outputting index to indicate the delay of adaptive codebook to the multiplexer 600. Further the value of delay of adaptive codebook is also output to the delay circuit 410.

$$D_T = \sum_{n=0}^{N-1} x'^2_w(n) - \left[\sum_{n=0}^{N-1} x'_w(n) y_w(n-T)\right]^2 \Big/ \left[\sum_{n=0}^{N-1} y^2_w(n-T)\right]^2 \tag{8}$$

where, $$y_w(n-T) = v(n-T) * h_w(n) \tag{9}$$

In equation 9, code (*) represents convolution operation. Then the adaptive codebook circuit 500 calculates gain β according to the equation below.

$$\beta = \sum_{n=0}^{N-1} x_w(n) y_w(n-T) \Big/ \left[\sum_{n=0}^{N-1} y^2_w(n-T)\right] \tag{10}$$

by Here, in order to enhance the precision of delay extraction of adaptive codebook for woman's voice or child's voice, the delay of adaptive codebook may be calculated not by integer sample value but by decimal sample value. For example, the detailed method is described in P. Kroon et al., "Pitch Predictors with High Temporal Resolution", Proc. ICASSP, pp.661–664, 1990 (prior art 11).

Further, the adaptive codebook circuit 500 conducts the pitch prediction according to equation 10, outputting the predictive residual signal $e_w(n)$ to the excitation quantization circuit 350.

$$e_w(n) = x_w(n) - \beta v(n-T) * h_w(n) \tag{11}$$

The excitation quantization circuit 350 that serves to output quantizing the excitation signal of speech signal by using spectral parameter sets up m pulses as the excitation signal. Also, the excitation quantization circuit 350 has B-bit of amplitude codebook or polarity codebook for quantizing M of pulse amplitudes in a lump. The example of using the polarity codebook is explained below. The polarity codebook is stored in a sound-source codebook 352.

The excitation quantization circuit 350 reads the polarity code vector stored in the sound-source codebook 352, assigning a position to each code vector, selecting such multiple combinations of code vector and position that minimizes equation 12 below.

$$\Phi(n) = \sum_{i=n}^{N-1} e_w(i)h_w(i-n), \quad n = 0, \ldots, N-1 \tag{12}$$

where $h_w(n)$ is perceptual weighting impulse response. Equation 12 can be minimized if only calculating the combination of polarity code vector $g_{ik}$ and position mi to maximize equation 13 below.

$$D_{(k,j)} = \left[\sum_{n=0}^{N-1} e_w(n)s_{wk}(m_i)\right]^2 \Big/ \left[\sum_{n=0}^{N-1} s_{wk}^2(m_i)\right] \tag{13}$$

Alternatively, they can be selected by maximizing equation 14 below. This can reduce the amount of calculation required to the numerator in equation.

$$D_{(k,j)} = \left[\sum_{n=0}^{N-1} \Phi(n)v_k(n)\right]^2 \Big/ \left[\sum_{n=0}^{N-1} s_{wk}^2(m_i)\right] \tag{14}$$

where, $$\Phi(n) = \sum_{i=n}^{N-1} e_w(i)h_w(i-n), \quad n = 0, \ldots, N-1 \tag{15}$$

Here, the position where each pulse can exist can be restricted so as to reduce the amount of calculation, as shown in prior art 4. For example, when N=40 and M=5, the position where each pulse can exist is as shown in Table 2.

TABLE 2

| Pulse Number | Position |
|---|---|
| First pulse | 0, 5, 10, 15, 20, 25, 30, 35 |
| Second pulse | 1, 6, 11, 16, 21, 26, 31, 36 |
| Third pulse | 2, 7, 12, 17, 22, 27, 32, 37 |
| Fourth pulse | 3, 8, 13, 18, 23, 28, 33, 38 |
| Fifth pulse | 4, 9, 14, 19, 24, 29, 34, 39 |

After searching the polarity code vector, the excitation quantization circuit 350 outputs the multiple selected combinations of polarity code vector and position to the gain quantization circuit 365.

The gain quantization circuit 365 that serves to output quantizing the gain of excitation signal is input with the multiple selected combinations of polarity code vector and pulse position from the excitation quantization circuit 350. The gain quantization circuit 365 reads gain code vector from a gain codebook 380, searching such gain code vector that equation 16 can be minimized in the multiple selected combinations of polarity code vector and pulse position, selecting such one combination of gain code vector, polarity code vector and position that can minimize the distortion.

$$D_k = \sum_{n=0}^{N-1} \left[x_w(n) - \beta_i v(n-T)^* h_w(n) - G_i' \sum_{i=1}^{M} g_{ik}' h_w(n-m_i)\right]^2 \tag{16}$$

Herein explained is an example that the gain quantization circuit 365 conducts simultaneously the vector quantization of both the gain of adaptive codebook and the gain of pulse-indicated sound-source. The gain quantization circuit 365 outputs index to indicate the polarity code vector, code to indicate the position and index to indicate the gain code vector to the multiplexer 600.

Meanwhile, the codebook to quantize the amplitude of multiple pulses may be, in advance, subject to the learning by using speech signal, and then stored. For example, the method of learning the codebook is described in Linde et al., "An Algorithm for Vector Quantization Design", IEEE Trans. Commun.,pp.84–95, January, 1980 (prior art 12).

The weighting signal calculation circuit 360 is explained below. The weighting signal calculation circuit 360 is input with each index, reading code vector corresponding to the index, then calculating drive excitation signal v(n) according to equation 17.

$$v(n) = \beta_i' v(n-T)^* h_w(n) + G_i' \sum_{i=1}^{M} g_{ik}' \delta(n-m_i)\Big]^2 \tag{17}$$

The drive excitation signal v(n) is output to the adaptive codebook circuit 500. Then, the weighting signal calculation circuit 360 calculates response signal $s_w(n)$ for each subframe by using the output parameter of the spectral parameter calculation circuit 200 and the output parameter of the spectral parameter quantization circuit 210 according to equation 18, outputting it to the response signal calculation circuit 240.

$$s_w(n) = v(n) - \sum_{i=1}^{10} \alpha_i v(n-i) + \sum_{i=1}^{10} \alpha_i \gamma^i p(n-i) + \sum_{i=1}^{10} \alpha_i \gamma^i s_w(n-i) \tag{18}$$

The multiplexer 600 is input with index to indicate the code vector of quantized LSP for the fourth subframe from the spectral parameter quantization circuit 210, input with the combination of polarity code vector and position from the excitation quantization circuit 350, input with index to indicate the polarity code vector, code to indicate the position and index to indicate the gain code vector from the gain quantization circuit 365. Based on these inputs, the multiplexer 600 outputs reconstructing the code corresponding to speech signal divided into subframes. Thus, the encoding of input speech signal is completed.

In this speech encoding system, the limiter circuit 411 is input with the delay of adaptive codebook obtained for the previous subframe, and the pitch cycle search range is limited so that the delay of adaptive codebook obtained for the previous subframe is not discontinuous to the delay of adaptive codebook to be obtained for the current subframe, and the pitch cycle search range limited is output to the pitch calculation circuit 400.

The pitch calculation circuit 400 is input with output signal $X_w(n)$ of the perceptual weighting circuit 230 and the pitch cycle search range output from the limiter 411, calculating the pitch cycle $T_{op}$, then outputting at least one pitch cycle $T_{op}$ to the adaptive codebook circuit 500. The adaptive codebook circuit 500 is input with the perceptual weighting signal $x'_w(n)$, the past excitation signal v(n) output from the gain quantization circuit 365, the perceptual weighting impulse response $h_w(n)$ output from the impulse response calculation circuit 310, and the pitch cycle $T_{op}$ from the pitch calculation circuit 400, searching near the pitch cycle, calculating the delay of adaptive codebook. By using the above composition, the delay of adaptive codebook obtained for each subframe can be prevented from being discontinuous in the process of time.

Second Embodiment

Figure 2:
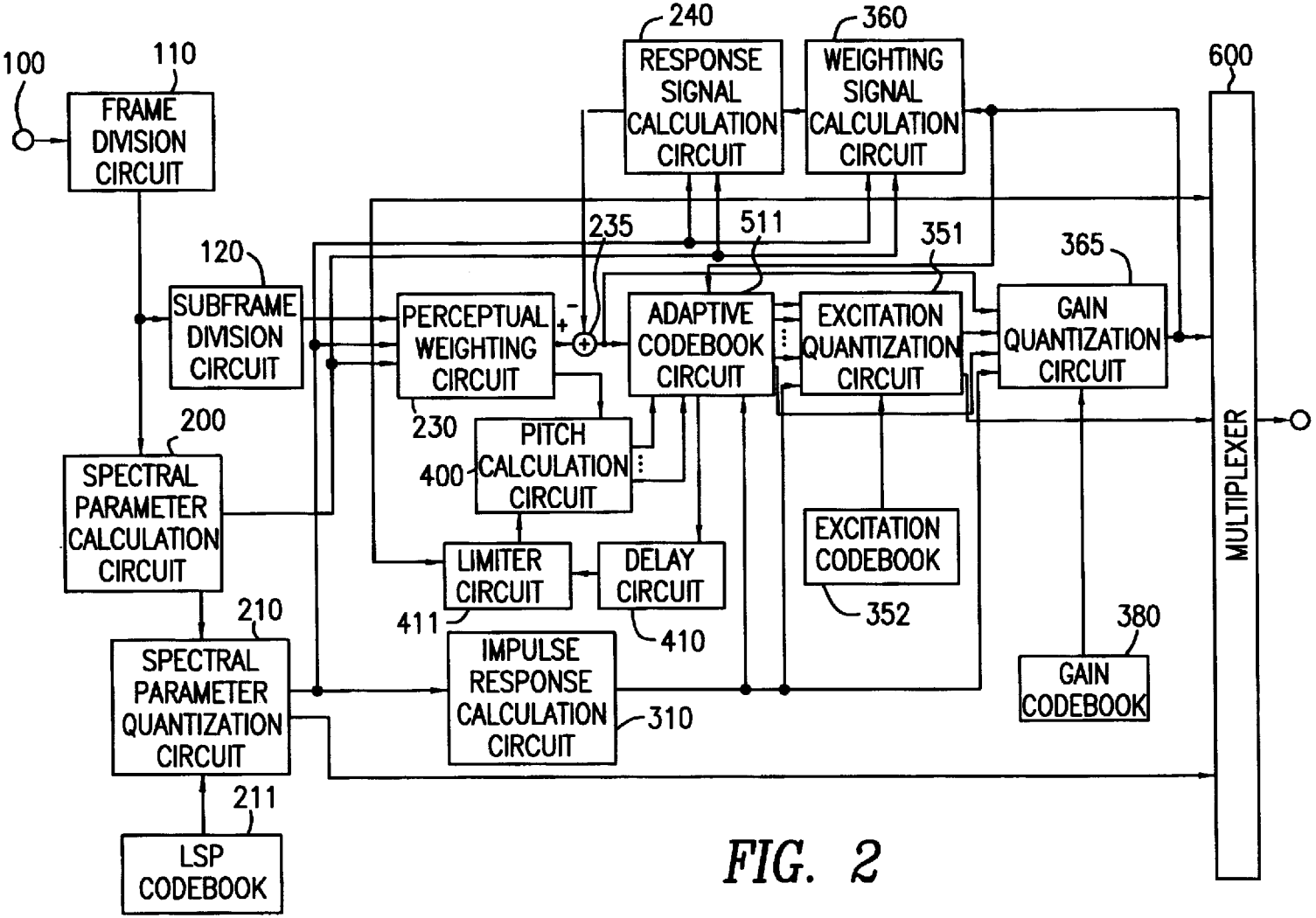
FIG. 2 is a block diagram showing the composition of a speech encoding system in a second preferred embodiment according to the invention.

Referring to FIG. 2, the composition of a speech encoding system in the second preferred embodiment according to the invention will be explained. This speech encoding system is different from the system in FIG. 1, as to the operations of the adaptive codebook circuit and excitation quantization circuit. In FIG. 2, like components are indicated by like numerals used in FIG. 1.

The adaptive codebook circuit 511 calculates the delay of adaptive codebook so as to minimize equation 8, then outputting multiple prospects to the excitation quantization circuit 351. For these prospects, in the excitation quantization circuit 351 and gain quantization circuit 365, the quantization of sound-source and gain is conducted as in the first embodiment, and, finally, one combination to minimize equation 16 is selected from the multiple prospects. The other operations are similar to those in the first embodiment.

Also in this speech encoding system, the search range of pitch cycle is limited based on the delay of adaptive codebook calculated in the past. Therefore, the delay of adaptive codebook calculated for each subframe can be prevented from being discontinuous in the process of time.

Third Embodiment

Figure 3:
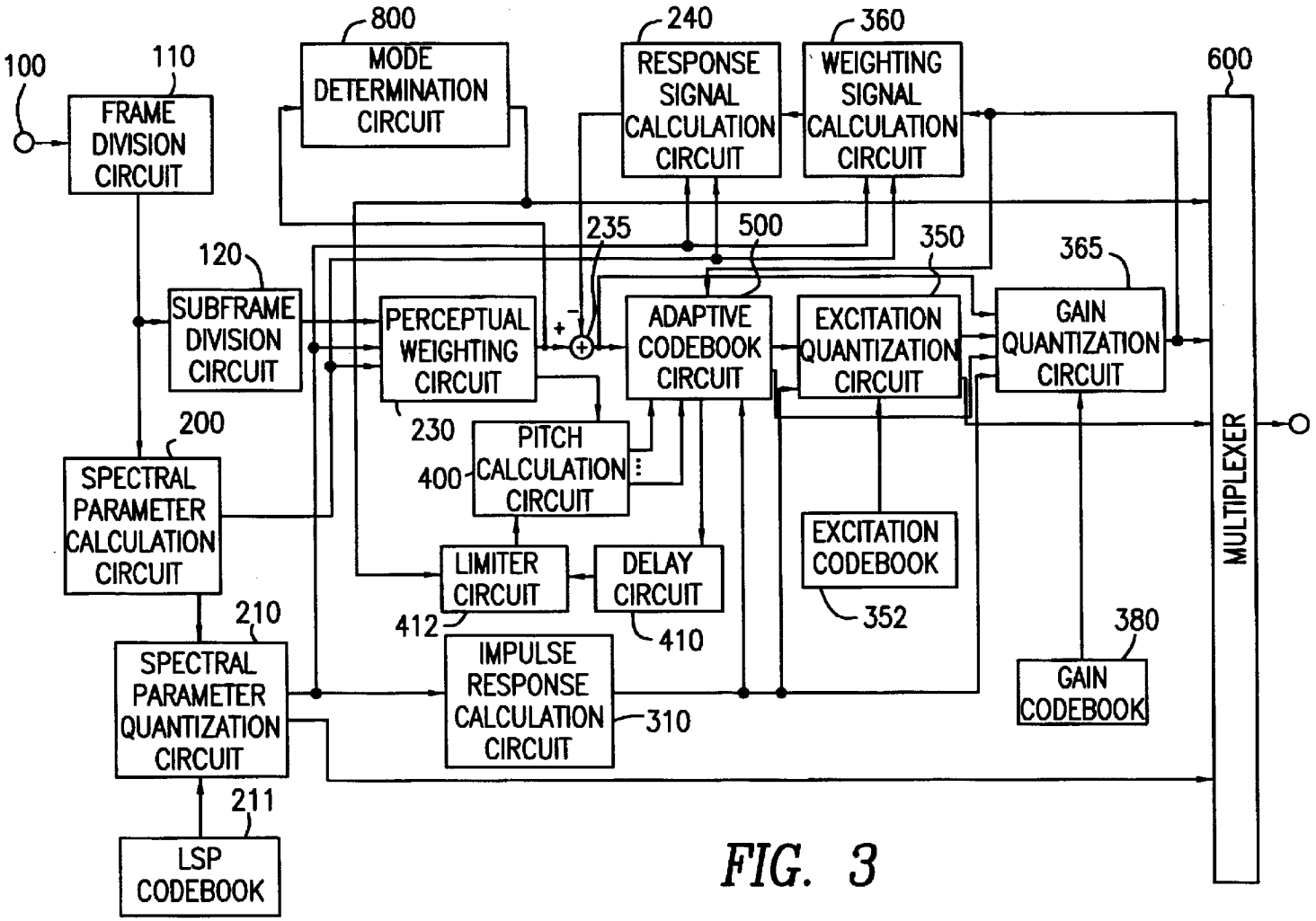
FIG. 3 is a block diagram showing the composition of a speech encoding system in a third preferred embodiment according to the invention.

Referring to FIG. 3, the composition of a speech encoding system in the third preferred embodiment according to the invention will be explained. This speech encoding system is different from the system in FIG. 1 in that it is provided with a mode determination circuit 800 and the operation of the limiter circuit is altered. In FIG.3, like components are indicated by like numerals used in FIG. 1.

With the mode determination circuit 800 enabling to set multiple modes, though not shown, the operational conditions of adaptive codebook circuit 500 can be changed depending on the mode to be set. Thus, an optimum encoding can be set for each mode, and therefore a high-quality speech encoding can be performed at a low bit rate.

The mode determination circuit 800 extracts characteristic quantity by using the output signal of the perceptual weighting circuit 230, thereby determining the mode for each frame. Here, as the characteristic quantity, pitch predictive gain can be used. The pitch predictive gain obtained for each subframe is averaged in the entire frame, this average is compared with multiple predetermined thresholds and is classified into one of multiple predetermined modes. For example, herein, four kinds of modes are used. In this case, modes 0, 1, 2 and 3 correspond approximately to voiceless section, transitional section, weak vocal section and strong vocal section, respectively. For example, according to these modes, the limiter circuit 412 does not limit the pitch cycle search at mode 0, and limits the pitch cycle search at modes 1, 2 and 3. Like this, it switches the search range. Meanwhile, information to indicate the mode determined is also output from the mode determination circuit 800 to the multiplexer 600. The other operations are similar to those in the first embodiment.

Fourth Embodiment

Figure 4:
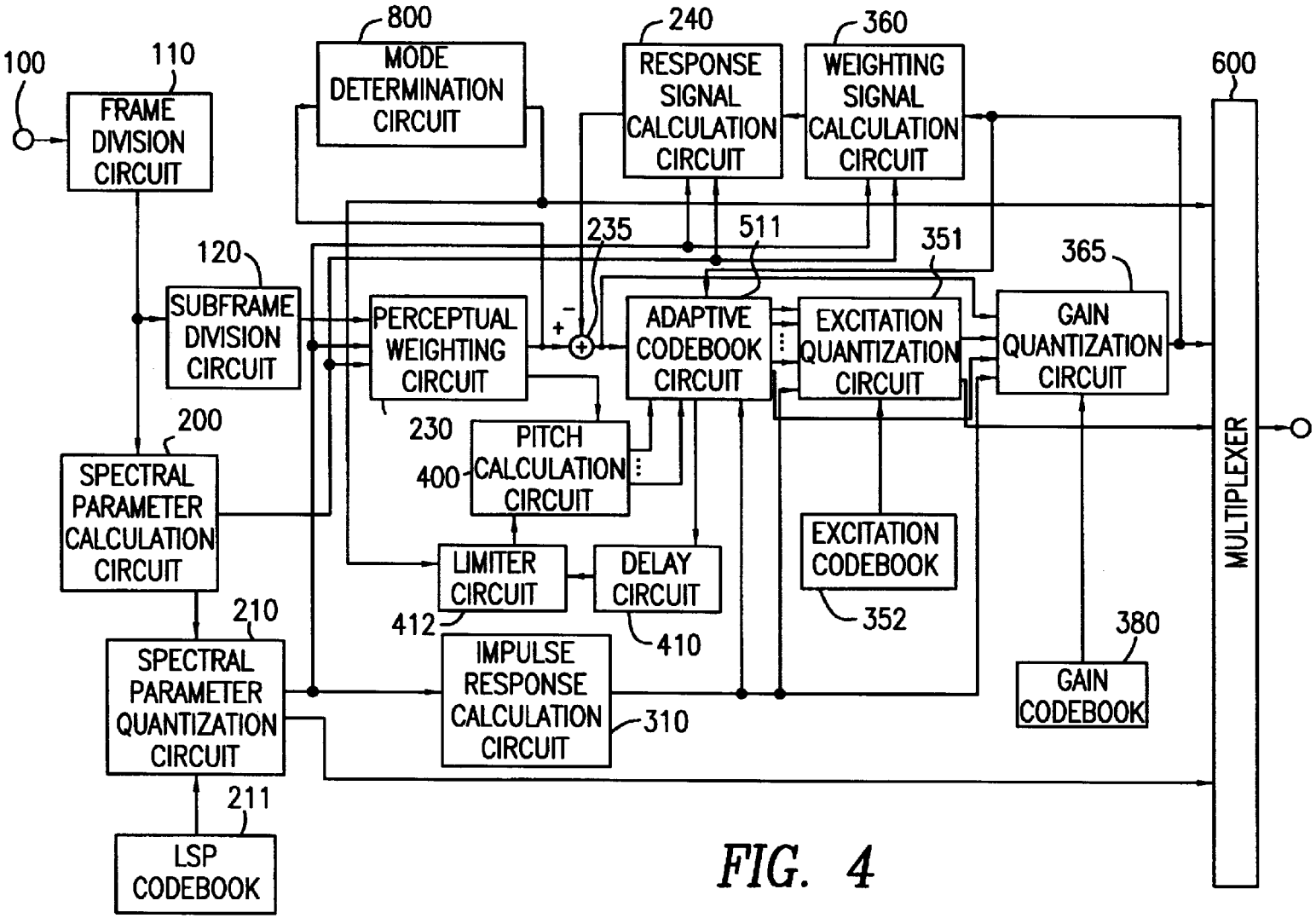
FIG. 4 is a block diagram showing the composition of a speech encoding system in a fourth preferred embodiment according to the invention.

Referring to FIG. 4, the composition of a speech encoding system in the fourth preferred embodiment according to the invention will be explained. This speech encoding system is different from the system in FIG. 2 in that it is provided with the mode determination circuit 800 and the operation of the limiter circuit is altered. In FIG. 4, like components are indicated by like numerals used in FIG. 2.

With the mode determination circuit 800 enabling to set multiple modes like the third embodiment, a high-quality speech encoding can be performed at a low bit rate.

The mode determination circuit 800 extracts characteristic quantity by using the output signal of the perceptual weighting circuit 230, thereby determining the mode for each frame. Here, as the characteristic quantity, pitch predictive gain can be used. The pitch predictive gain obtained for each subframe is averaged in the entire frame, this average is compared with multiple predetermined thresholds and is classified into one of multiple predetermined modes. For example, herein, four kinds of modes are used. In this case, modes 0, 1, 2 and 3 correspond approximately to voiceless section, transitional section, weak vocal section and strong vocal section, respectively. For example, according to these modes, the limiter circuit 412 does not limit the pitch cycle search at mode 0, and limits the pitch cycle search at modes 1, 2 and 3. Like this, it switches the search range. Meanwhile, information to indicate the mode determined is also output from the mode determination circuit 800 to the multiplexer 600. The other operations are similar to those in the second embodiment.

Although the invention has been described with respect to specific embodiment for complete and clear disclosure, the appended claims are not to be thus limited but are to be construed as embodying all modification and alternative constructions that may be occurred to one skilled in the art which fairly fall within the basic teaching here is set forth.

What is claimed is:

1. A speech encoding method, comprising:

calculating a spectral parameter from a current frame of a speech signal and quantizing said spectral parameter;

calculating a delay and a gain for an adaptive codebook for said current frame of said speech signal using a previously quantized excitation signal from a previous frame of said speech signal;

quantizing an excitation signal of said current frame of said speech signal using said spectral parameter;

quantizing a gain of said excitation signal; and limiting a search range of an adaptive code vector within a range defined by a pitch position calculated in said previous frame of said speech signal and searching said delay from said current frame of said speech signal.

2. A speech encoding method, comprising:

calculating a spectral parameter from a current frame of a speech signal and quantizing said spectral parameter;

calculating a delay and a gain for an adaptive codebook for said current frame of said speech signal using a previously quantized excitation signal from a previous frame of said speech signal;

quantizing an excitation signal of said current frame of said speech signal using said spectral parameter;

quantizing a gain of said excitation signal;

determining a mode by extracting a characteristic quantity from said speech signal; and limiting a search range of an adaptive code vector within a range defined by a pitch position calculated in said previous frame of said speech signal and searching said delay from said current frame of said speech signal when said determined mode corresponds to a predetermined mode.

3. A speech encoding system, comprising:

a spectral parameter calculation unit that calculates a spectral parameter from a current frame of a speech signal and quantizes said spectral parameter;

a pitch calculation unit that calculates and outputs a delay from said current frame of said speech signal;

an adaptive codebook unit that calculates a delay and a gain for an adaptive codebook for said current frame of said speech signal using a previously quantized excitation signal from a previous frame of said speech signal, and that outputs said calculated delay and gain;

an excitation quantization unit that quantizes and outputs an excitation signal of said current frame of said speech signal using said spectral parameter;

a gain quantization unit that quantizes and outputs a gain of said excitation signal; and a limiter unit that limits a search range of an adaptive code vector within a range defined by a pitch position calculated in said previous frame of said speech signal, wherein said pitch calculation unit outputs a result of searching said delay from said current frame of said speech signal based on the output of said limiter unit.

4. A speech encoding system, comprising:

a spectral parameter calculation unit that calculates a spectral parameter from a current frame of a speech signal and quantizes said spectral parameter;

a pitch calculation unit that calculates and outputs a delay from said current frame of said speech signal;

an adaptive codebook unit that calculates multiple delays and gain for an adaptive codebook for said current frame of said speech signal using a previously quantized excitation signal from a previous frame of said speech signal, and that outputs said calculated delays and gain;

an excitation quantization unit that quantizes an excitation signal of said current frame of said speech signal for each of said multiple delays using said spectral parameter and then outputs an excitation signal with the least signal distortion;

a gain quantization unit that quantizes and outputs the gain of said excitation signal; and a limiter unit that limits a search range of an adaptive code vector within a range defined by a pitch position calculated in said previous frame of said speech signal, wherein said pitch calculation unit outputs a result of searching said delay from said current frame of said speech signal based on the output of said limiter unit.

5. A speech encoding system, comprising:

a spectral parameter calculation unit that calculates a spectral parameter from a current frame of a speech signal and quantizes said spectral parameter;

a pitch calculation unit that calculates and outputs a delay from said current frame of said speech signal;

an adaptive codebook unit that calculates a delay and a gain for an adaptive codebook for said current frame of said speech signal using a previously quantized excitation signal from a previous frame of said speech signal, and that outputs said calculated delay and gain;

an excitation quantization unit that quantizes and outputs an excitation signal of said current frame of said speech signal using said spectral parameter;

a mode determination unit that determines a mode by extracting a characteristic quantity from said current frame of said speech signal;

a gain quantization unit that quantizes and outputs the gain of said excitation signal; and a limiter unit that limits a search range of an adaptive code vector within a range defined by a pitch position calculated in said previous frame of said speech signal when the output of said mode determination unit corresponds to a predetermined mode, wherein said pitch calculation unit outputs a result of searching said delay from said current frame of said speech signal based on the output of said limiter unit when the output of said mode determination unit corresponds to the predetermined mode.

6. A speech encoding system, comprising:

a spectral parameter calculation unit that calculates a spectral parameter from a current frame of a speech signal and quantizes said spectral parameter;

a pitch calculation unit that calculates and outputs a delay from said current frame of said speech signal;

an adaptive codebook unit that calculates multiple delays and gain for an adaptive codebook for said current frame of said speech signal using a previously quantized excitation signal from a previous frame of said speech signal, and that outputs said calculated delays and gain;

an excitation quantization unit that quantizes an excitation signal of said current frame of said speech signal using said spectral parameter and then outputs an excitation signal with the least signal distortion;

a mode determination unit that determines a mode by extracting a mode by extracting a characteristic quantity from said current frame of said speech signal;

a gain quantization unit that quantizes and outputs the gain of said excitation signal; and a limiter unit that limits a search range of an adaptive code vector within a range defined by a pitch position calculated in said previous frame of said speech signal when the output of said mode determination unit corresponds to a predetermined mode, wherein said pitch calculation unit outputs a result of searching said delay from said current frame of said speech signal based on the output of said limiter unit when the output of said mode determination unit corresponds to the predetermined mode.

* * * * *